US011572742B2

(12) United States Patent
Goren

(10) Patent No.: US 11,572,742 B2
(45) Date of Patent: Feb. 7, 2023

(54) AUTOMATIC HANDHELD SHOVEL WITH AUGER

(71) Applicant: Richard Goren Enterprises, LLC, Fishers, IN (US)

(72) Inventor: Richard H. Goren, Fishers, IN (US)

(73) Assignee: Richard Goren Enterprises, LLC, Fishers, IN (US)

( * ) Notice: Subject to any disclaimer, the term of this patent is extended or adjusted under 35 U.S.C. 154(b) by 0 days.

(21) Appl. No.: 17/248,128

(22) Filed: Jan. 11, 2021

(65) Prior Publication Data

US 2021/0131192 A1 May 6, 2021

Related U.S. Application Data

(63) Continuation of application No. 16/410,157, filed on May 13, 2019, now Pat. No. 10,890,031, which is a (Continued)

(51) Int. Cl.

| | |
|---|---|
| ***E21B 11/00*** | (2006.01) |
| ***E02F 3/02*** | (2006.01) |
| ***E21B 10/44*** | (2006.01) |

(52) U.S. Cl.
CPC ..... *E21B 11/005* (2013.01); *E02F 3/02* (2013.01); *E21B 10/44* (2013.01)

(58) Field of Classification Search
CPC ..... E21B 7/20; E21B 10/44; E21B 11/005; E02F 3/02
See application file for complete search history.

(56) References Cited

U.S. PATENT DOCUMENTS 181,983 A * 9/1876 Pulse ..... E21B 11/005 175/384
368,626 A * 8/1887 Tevebaugh ..... E21B 11/005 175/316

(Continued)

FOREIGN PATENT DOCUMENTS

EP 0241750 B1 3/1991
EP 3252262 A1 12/2017

(Continued)

OTHER PUBLICATIONS

PC, Int. App. No. PCT/US2019/070012 International Search Report, 3 pages, dated Apr. 6, 2020.

(Continued)

*Primary Examiner* — Jennifer H Gay
(74) *Attorney, Agent, or Firm* — Woodard, Emhardt, Henry, Reeves & Wagner, LLP

(57) ABSTRACT

An electrical handheld shovel system includes a handheld shovel with an auger bit. The shovel includes a motor configured to rotate the auger bit and a portable power source configured to power the motor. The shovel includes an input/output (I/O) device and a controller to control rotation of the auger bit. The shovel has a handle and a shovel portion. In one example, the power source is integrated into the handle, and in another example, the power source is detachably coupled to the handle. The shovel has a gearbox coupled to the motor. The shovel portion includes a blade positioned proximal to the auger bit to retain debris from the auger bit. The auger bit has a flute that is partially covered by the blade, and the blade defines a discharge opening configured to discharge at least some of the debris.

22 Claims, 10 Drawing Sheets

Related U.S. Application Data continuation of application No. 16/213,411, filed on Dec. 7, 2018, now Pat. No. 10,309,160.

(56) References Cited

U.S. PATENT DOCUMENTS 474,664 A * 5/1892 Justesen ..... E21B 10/44 175/388
1,067,417 A * 7/1913 Erzig ..... E21B 11/005 175/384
1,106,097 A * 8/1914 Iwan ..... E21B 11/005 175/396
1,110,517 A * 9/1914 Watkins et al. ..... E21B 11/005 175/396
1,114,206 A * 10/1914 Watkins et al. ..... E21B 11/005 175/396
1,142,646 A * 6/1915 Watkins et al. ..... E21B 11/005 175/396
1,305,792 A * 6/1919 Fraser ..... E21B 10/44 175/391
1,442,883 A * 1/1923 Gilbert ..... E21B 11/005 254/131.5
2,021,982 A * 11/1935 Byrne ..... E21B 10/02 175/398
2,385,441 A * 9/1945 Hill ..... A01B 1/00 175/394
2,571,244 A * 10/1951 Hollander ..... E21B 11/005 403/379.3
2,735,703 A * 2/1956 Goodman ..... E21B 27/04 175/388
3,332,501 A * 7/1967 Parish ..... E21B 11/005 111/101
3,401,760 A * 9/1968 Balliano ..... A01C 5/02 175/308
3,444,940 A * 5/1969 Thomas ..... E21B 10/44 175/394
3,593,809 A 7/1971 Derry
3,662,844 A 5/1972 Baker
RE27,498 E * 10/1972 Watson ..... E21B 10/44 175/408
3,747,697 A 7/1973 Russell
4,653,336 A * 3/1987 Vollweiler ..... E21B 25/00 73/864.44
4,779,689 A 10/1988 Paxton
4,807,710 A 2/1989 Greeley
5,209,534 A * 5/1993 Crenshaw ..... E21B 27/00 294/50.6
6,145,600 A 11/2000 Dickinson
6,296,068 B1 10/2001 Frederick
6,643,958 B1 11/2003 Krejci
7,770,669 B1 * 8/2010 Desrochers ..... E21B 7/20 405/249
8,479,942 B2 7/2013 Antal
8,544,910 B1 * 10/2013 Weist ..... A01B 1/22 294/49
9,999,969 B1 * 6/2018 Walter ..... B01F 33/50115
10,309,160 B1 * 6/2019 Goren ..... E21B 10/44
10,837,156 B1 * 11/2020 Olsen ..... E21B 11/005
11,047,174 B2 * 6/2021 Wong ..... E21B 7/022
2005/0000736 A1 * 1/2005 Maki ..... E21B 10/44 175/394
2005/0248166 A1 * 11/2005 Warren ..... A01B 1/02 294/49
2008/0250570 A1 * 10/2008 Dayton ..... B25F 3/00 173/217
2010/0074702 A1 * 3/2010 Kluge ..... A01K 97/01 408/125
2015/0264853 A1 * 9/2015 Anthony ..... A01B 1/02 294/49
2016/0090792 A1 * 3/2016 Grewal ..... A01C 5/02 175/320
2016/0324060 A1 11/2016 Pope et al.
2017/0027096 A1 2/2017 Smith
2017/0168504 A1 6/2017 Darms et al.
2020/0181987 A1 * 6/2020 Goren ..... E02F 3/02
2021/0131192 A1 * 5/2021 Goren ..... E21B 10/44

FOREIGN PATENT DOCUMENTS

JP S58176325 A 10/1983
WO WO-2017219097 A1 * 12/2017 ..... B07B 1/02

OTHER PUBLICATIONS

PC, Int. App. No. PCT/US2019/070012 Written Opinion, 9 pages, dated Apr. 6, 2020.
PC, Int. App. No. PCT/US2019/070012 International Preliminary Report on Patentability, 11 pages, dated Jun. 17, 2021.
EPO, Extended European Search Report for EP App. No. 19893288.1, dated Jul. 5, 2022.

* cited by examiner

AUTOMATIC HANDHELD SHOVEL WITH AUGER

CROSS-REFERENCE TO RELATED APPLICATION

This application is a continuation of U.S. patent application Ser. No. 16/410,157, filed May 13, 2019, which is hereby incorporated by reference. U.S. patent application Ser. No. 16/410,157, filed May 13, 2019, is a continuation of U.S. patent application Ser. No. 16/213,411, filed Dec. 7, 2018, which are hereby incorporated by reference.

BACKGROUND

The present invention Around typical home gardens and in commercial settings, there is always a need to dig small holes or channels in the ground. For example, garden trowels are commonly used for planting as well as to bury bulbs, outdoor lighting cables, outdoor audio cables, fence posts, sprinkler hoses, and the like. However, digging these holes and other cavities in the ground with a hand garden trowel can be a difficult and painful process. During digging, a significant clump of dirt or other debris usually falls off the trowel and back into the hole which in turn requires additional effort.

Thus, there is a need for improvement in this field.

SUMMARY

To address these as well as other issues, a unique powered handheld shovel has been developed. The handheld electric shovel includes a powered screw-auger bit to dig into the ground. A shovel or dig portion of the shovel is stationary while the auger bit is rotatable. The shovel portion of the device is then used for removal of the dirt by holding all of the dirt dug up by the auger bit generally in the form of a debris plug. In certain embodiments, the auger and shovel are made from a suitable metal and/or plastic material.

The electric shovel may be portably powered using a battery. In one particular form, the battery is a lithium rechargeable battery. The battery can be attached and detached on the end of the handle. On the interior of the handle is a high torque motor and gear box capable of controlling the rotation of the auger bit. The output shaft of the gearbox is connected to the auger bit. The handle includes a switch allowing the user to control the auger. In one particular example, when the switch is set to the right most position, the motor rotates counterclockwise causing the auger to dig into the ground. When the switch is set to the middle position, the motor turns off. When the switch is set to the left most position, the motor rotates clockwise causing the auger to discharge the debris or dirt plug that was removed from the hole. In one form, the handle is made from a suitable metal and/or plastic. Alternatively or additionally, the handle may be encased by a rubber grip.

In one specific example, the portable power electric shovel is designed for digging up dirt for gardening and landscaping use cases. The electric shovel in this example includes a shovel-like design with a screw-auger to dig into the ground. In one form, the electric shovel is powered by a 20 Volt (V) lithium rechargeable battery. The battery can be attached and detached on the end of the handle. To facilitate this, the handle has a battery mount. In one form, the auger bit is made from metal and is used to cut into dirt. In this form, the auger bit is no more than 220 millimeters (mm) tall, and the auger bit has a diameter of at most 95 mm. In one variation, the handle houses a 20V motor and a gearbox.

Aspect 1 generally concerns a system that includes a handheld shovel including a handle and a shovel portion attached to the handle with a blade and an auger bit.

Aspect 2 generally concerns the system of aspect 1 in which the handheld shovel includes a motor configured to rotate the auger bit.

Aspect 3 generally concerns the system of aspect 2 in which the handheld shovel includes an Energy Storage System (ESS) configured to power the motor.

Aspect 4 generally concerns the system of aspect 3 in which the handheld shovel includes an input/output (I/O) device and a controller to control rotation of the auger bit.

Aspect 5 generally concerns the system of aspect 3 in which the ESS is integrated into the handle.

Aspect 6 generally concerns the system of aspect 3 in which the ESS is detachably coupled to the handle.

Aspect 7 generally concerns the system of aspect 3 in which the shovel includes a gearbox coupled to the motor.

Aspect 8 generally concerns the system of aspect 7 in which the gearbox and the motor are housed inside the handle.

Aspect 9 generally concerns the system of aspect 3 in which the ESS includes a battery.

Aspect 10 generally concerns the system of aspect 1 in which the blade is positioned proximal to the auger bit to retain debris from the auger bit.

Aspect 11 generally concerns the system of aspect 10 in which the auger bit has a flute that is partially covered by the blade.

Aspect 12 generally concerns the system of aspect 11 in which the blade defines a discharge opening configured to discharge at least some of the debris.

Aspect 13 generally concerns the system of aspect 12 in which the blade has a semi-cylindrical shape that partially surrounds the auger bit.

Aspect 14 generally concerns the system of aspect 10 in which the auger bit has a helical web that contacts the blade.

Aspect 15 generally concerns the system of aspect 10 in which the auger bit has a helical web that is spaced from the blade to form a clearance gap of at most 1 cm.

Aspect 16 generally concerns the system of aspect 10 in which the blade has a cutting edge configured to cut into the ground.

Aspect 17 generally concerns the system of aspect 16 in which the auger bit has a tip that extends past the cutting edge of the blade.

Aspect 18 generally concerns the system of any previous aspect in which the handheld shovel includes a motor configured to rotate the auger bit.

Aspect 19 generally concerns the system of any previous aspect in which the handheld shovel includes an Energy Storage System (ESS) configured to power the motor.

Aspect 20 generally concerns the system of any previous aspect in which the handheld shovel includes an input/output (I/O) device and a controller to control rotation of the auger bit.

Aspect 21 generally concerns the system of any previous aspect in which the ESS is integrated into the handle.

Aspect 22 generally concerns the system of any previous aspect in which the ESS is detachably coupled to the handle.

Aspect 23 generally concerns the system of any previous aspect in which the shovel includes a gearbox coupled to the motor.

Aspect 24 generally concerns the system of any previous aspect in which the gearbox and the motor are housed inside the handle.

Aspect 25 generally concerns the system of any previous aspect in which the ESS includes a battery.

Aspect 26 generally concerns the system of any previous aspect in which the blade is positioned proximal to the auger bit to retain debris from the auger bit.

Aspect 27 generally concerns the system of any previous aspect in which the auger bit has a flute that is partially covered by the blade.

Aspect 28 generally concerns the system of any previous aspect in which the blade defines a discharge opening configured to discharge at least some of the debris.

Aspect 29 generally concerns the system of any previous aspect in which the blade has a semi-cylindrical shape that partially surrounds the auger bit.

Aspect 30 generally concerns the system of any previous aspect in which the auger bit has a helical web that contacts the blade.

Aspect 31 generally concerns the system of any previous aspect in which the auger bit has a helical web that is spaced from the blade to form a clearance gap of at most 1 cm.

Aspect 32 generally concerns the system of any previous aspect in which the blade has a cutting edge configured to cut into the ground.

Aspect 33 generally concerns the system of any previous aspect in which the auger bit has a tip that extends past the cutting edge of the blade.

Aspect 34 generally concerns a method of operating the system of any previous aspect.

Further forms, objects, features, aspects, benefits, advantages, and embodiments of the present invention will become apparent from a detailed description and drawings provided herewith.

DETAILED DESCRIPTION OF SELECTED EMBODIMENTS

Figure 1:
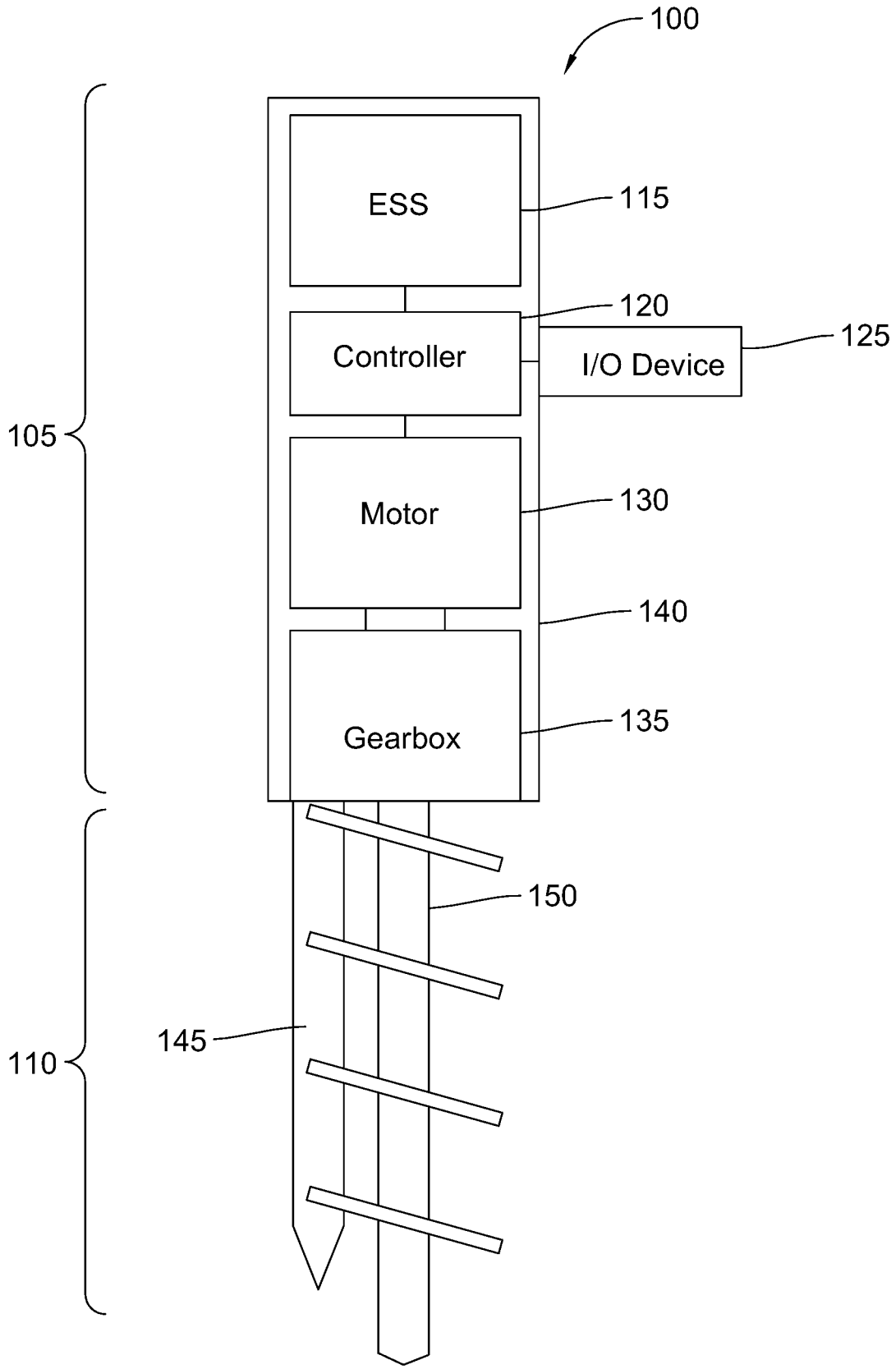
FIG. 1 is a diagrammatic view of a handheld shovel device according to one example.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

The reference numerals in the following description have been organized to aid the reader in quickly identifying the drawings where various components are first shown. In particular, the drawing in which an element first appears is typically indicated by the left-most digit(s) in the corresponding reference number. For example, an element identified by a "100" series reference numeral will likely first appear in FIG. 1, an element identified by a "200" series reference numeral will likely first appear in FIG. 2, and so on.

A diagrammatic view of a system for a handheld shovel device 100 according to one example is illustrated in FIG. 1. Among other things, the handheld shovel device 100 is designed to be easily picked up and handled by a single individual or user with one or two hands. The handheld shovel device 100 is configured to dig holes, trenches, and/or other cavities in the ground or other substrates. While the handheld shovel device 100 will be described below with respect to forming a hole in soil or the ground, it should be recognized that the handheld shovel device 100 can be used to form holes or other cavities in other types of substrates. For example, the handheld shovel device 100 can be used to dig a hole in beach sand for an umbrella. The handheld shovel device 100 can also be used to dig furrows in mulch commonly found in garden or flower beds.

As shown, the handheld shovel device 100 includes a handle 105 and a shovel portion 110. The handle 105 has an Energy Storage System ("ESS") 115 and a controller 120 operatively connected to receive power from the controller 120. To facilitate handheld operation of the handheld shovel device 100, the ESS 115 includes a portable power source such as a battery and/or fuel cell. In one particular example, the ESS 115 includes a 20V lithium ion battery. In one form, the ESS 115 is permanently incorporated into the handheld shovel device 100. In such a case, the power of the ESS 115 can be replenished in a number of manners. For instance, when the ESS 115 is a battery, the ESS 115 can be recharged through an external electrical source such as through a wireless recharging station and/or a wall outlet plug. When the ESS 115 is in the form of a fuel cell, fuel can be supplied to repower the ESS 115. In another form, the ESS 115 is replaceable. The ESS 115 for example can be detachably coupled to and/or housed inside the handle 105. Once the ESS 115 is drained, the ESS 115 can be replaced by a new and/or recharged ESS 115. For instance, the ESS 115 can include disposable or rechargeable batteries that are replaced once drained of power.

The handle 105 further includes an input/output device ("I/O device") 125 operatively connected to the controller 120, a motor 130 operatively connected to the controller 120, and a gearbox 135 mechanically coupled to the motor 130 for supplying mechanical power from the motor 130 to the shovel portion 110. The I/O device 125 through the controller 120 controls the operation of the motor 130 as well as the overall operation of the handheld shovel device 100. For example, the I/O device 125 can include a transducer, such as a switch or touch display, through which the user is able to control the rotational speed and/or direction of the motor 130. The controller 120 through I/O device 125 can further provide feedback, such as audio and/or visual cues, through the I/O device 125. The I/O device 125 can for instance provide an alert when there is a malfunction, an indicator of the status of the handheld shovel device 100, and/or a signifier of environmental conditions, to name just a few.

The motor 130 in one example includes a reversible electric motor, but the motor 130 in other cases can include other types of small, portable motors like pneumatic or hydraulic motors. Some motors 130, such as electric motors, have a normally high rotation per minute (RPM) and low torque output which would make such a high RPM, low torque motor 130 unsuitable for most use cases. In the illustrated example, the mechanical output of the motor 130 is connected to the gearbox 135 to reduce the resulting RPM and/or to increase the torque supplied to the shovel portion 110. In other variations, the gearbox 135 can be eliminated, and the motor 130 can have a direct mechanical connection with the shovel portion 110. As can be seen, the components of the handle 105 are mounted inside and/or outside of a housing 140. The housing 140 provides structural support for and protects the components of the handle 105. The housing 140 also provides a gripping surface where the user is able to grab and easily hold the handheld shovel device 100.

As can be seen in FIG. 1, the shovel portion 110 includes a blade 145 and an auger bit 150 positioned proximal to the blade 145. The blade 145 in one example is secured to the housing 140 such that the blade 145 remains stationary relative to the auger bit 150 as the auger bit 150 is rotated by the motor 130. The auger bit 150 is rotated by the motor 130 through the gearbox 135 in order to drill or dig a hole into the ground. The blade 145 is able to facilitate formation of the hole. The blade 145 is positioned next to the auger bit 150 such that the blade 145 is able to retain the debris in the auger bit 150 as the shovel portion 110 is removed from the dug hole. This helps to reduce the amount of soil or other debris from falling back into the hole during the digging process.

It should be recognized that the components of the handheld shovel device 100 can be connected or otherwise configured in other ways besides what is depicted in FIG. 1. The ESS 115, controller 120, I/O device 125, and motor 130 can be operatively connected together through wires and/or a wireless connection. In one example, the ESS 115 can be directly connected to the motor 130 in order to supply power directly to the motor 130. The I/O device 125 in other variations is directly connected to the motor 130 to control the operation of the motor 130. Moreover, as should be appreciated, one or more of these components can be integrated together to form a single unit. For instance, the I/O device 125 can be integrated with the controller 120 and the motor 130 to form a single unit. Alternatively or additionally, the gearbox 135 can be integrated into the motor 130 to form a single unit.

Figure 2:
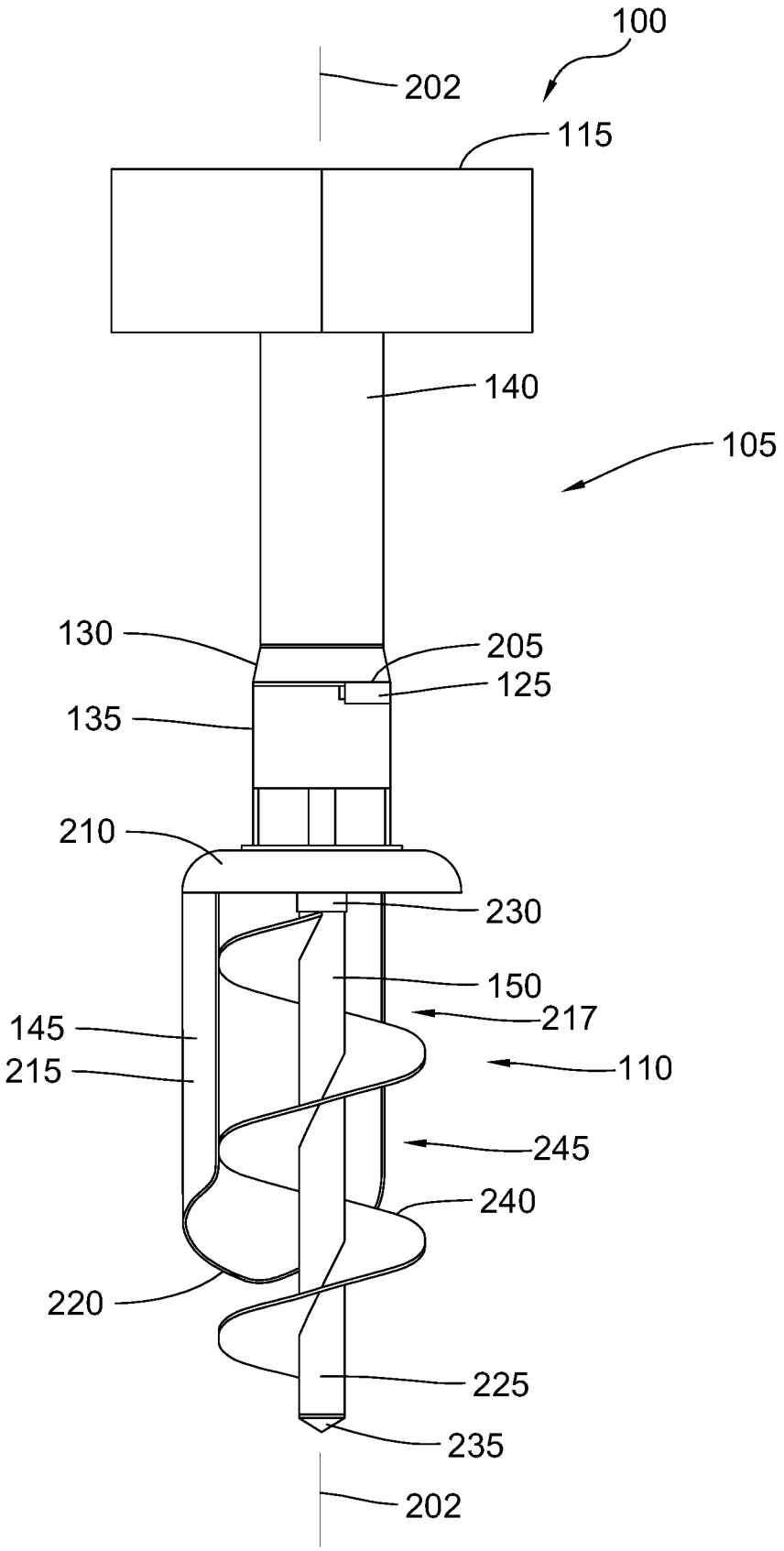
FIG. 2 is a perspective view of a handheld shovel device.
Figure 3:
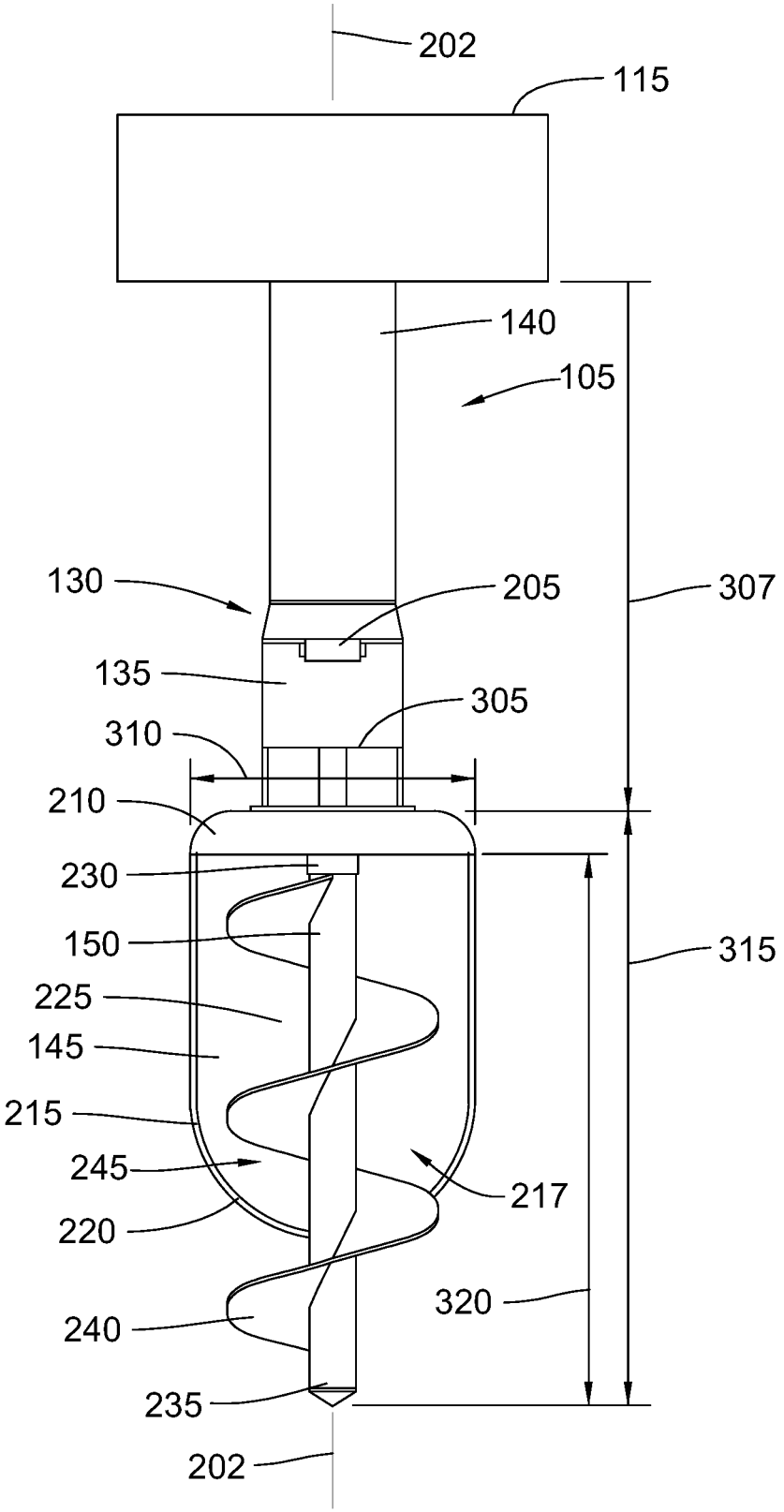
FIG. 3 is a front view of the FIG. 2 handheld shovel device.
Figure 4:
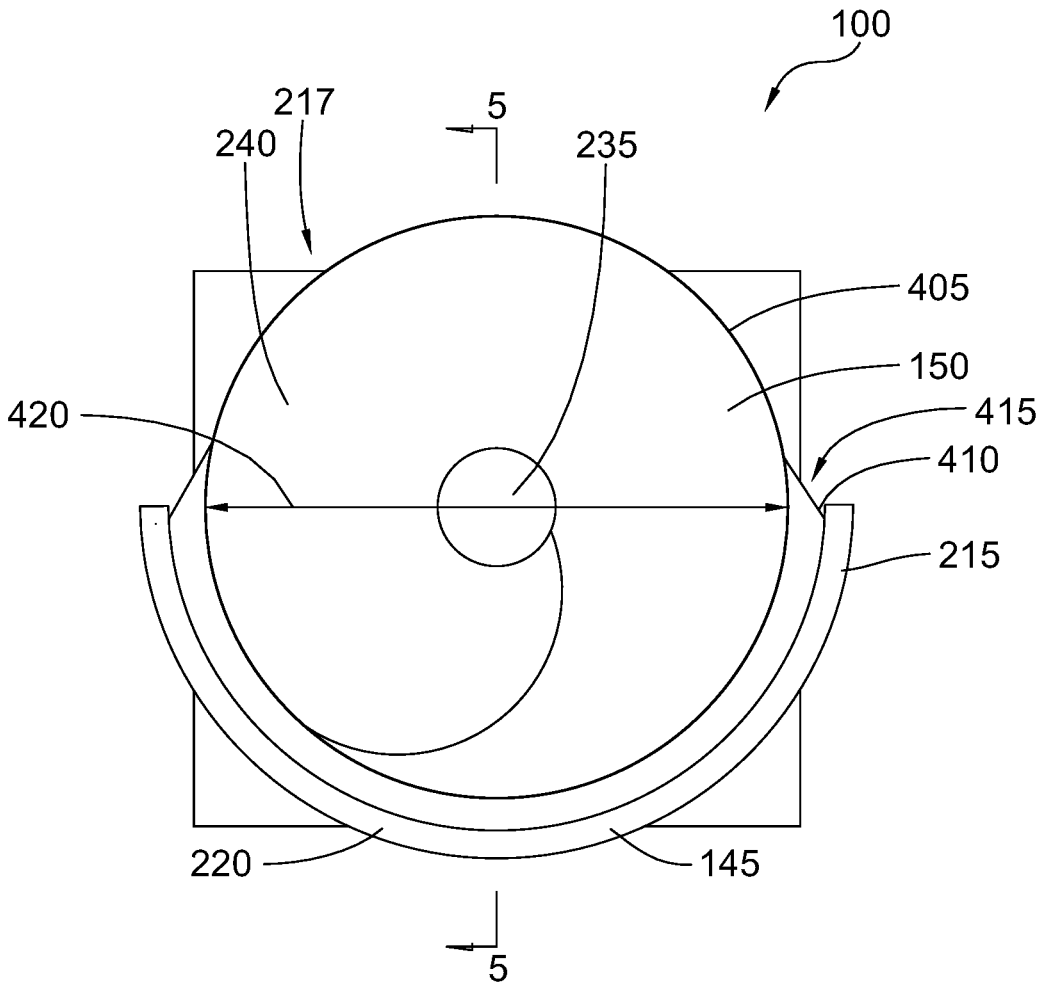
FIG. 4 is a bottom view of the FIG. 2 handheld shovel device.

Turning to FIGS. 2, 3, and 4, the components of the handheld shovel device 100 are generally aligned along a longitudinal axis 202 so that handheld shovel device 100 is generally balanced and easy to handle. Once more, the handheld shovel device 100 is designed to be a handheld type tool. In other words, the handheld shovel device 100 is designed to be easily picked up and handled by a single individual or user with one or two hands. In the illustrated example, the handheld shovel device 100 has the size and weight comparable to a hand garden trowel. In another example, the handheld shovel device 100 is sized somewhat larger to be comparable in size and function to that of a garden spade or shovel. As depicted, the ESS 115 is detachably attached to the end of the handle 105 so that the ESS 115 can be easily replaced with a new one or one that has been recharged. The I/O device 125 in the depicted example includes a multiway switch 205. The multiway switch 205 in one variation includes a three way switch with positions for causing the auger bit 150 to rotate in clockwise or counterclockwise directions, or to stop. The multiway switch 205 is positioned on the housing 140 of the handle 105 so that the multiway switch 205 can be readily actuated by the finger or thumb of the operator. In another variation, the multiway switch 205 includes a variable switch that incrementally adjusts the speed and direction of rotation of the auger bit 150.

As shown, the blade 145 has a shoulder 210 that is secured to the housing 140 of the handle 105. The blade 145 has a body 215 that has a semi-cylindrical shape that coincides with the overall cylindrical shape of the auger bit 150. The body 215 in the depicted example only covers a portion of the auger bit 150 to form a discharge opening 217 that allows the auger bit 150 to discharge soil or other debris during digging of the hole. The discharge opening 217 extends along the longitudinal axis 202 to expose one lateral side of the auger bit 150. Once more, the blade 145 helps to retain a plug of the debris within the handheld shovel device 100 to minimize spilling of the soil back into the hole during removal of the blade 145 from the hole. Opposite the shoulder 210, the blade 145 has a cutting edge 220 that is curved or pointed to further facilitate digging.

The auger bit 150 includes a shaft 225 with a shank 230 where the auger bit 150 is connected to the gearbox 135 of the handle 105. As shown, the shaft 225 of the auger bit 150 extends along and rotates about the longitudinal axis 202. Opposite the shank 230, the auger bit 150 has a tip 235 where the auger bit 150 first contacts the ground during digging of the hole. In the depicted example, the tip 235 is pointed to facilitate penetration in the ground and centering of the handheld shovel device 100 at the site of the hole. In the illustrated embodiment, the auger bit 150 has a web 240 that extends in a helical pattern around the shaft 225 to form a flute 245 that similarly has a helical shape. In other examples, the auger bit 150 can be shaped differently than illustrated. For example, the auger bit 150 can have two or more webs 240 and/or two or more flutes 245. The web 240 in other examples can be discontinuous and/or positioned around the shaft 225 in a non-helical pattern. The web 240 can be arranged in a right or left handed helical pattern in other variations. Moreover, the handheld shovel device 100 can have two or more blades 145 and/or auger bits 150.

As noted before, the handheld shovel device 100 is configured and sized to be easily operated using one hand. Consequently, the handheld shovel device 100 is sized accordingly. In one example, the housing 140 of the handle 105 has a motor-gearbox diameter 305 that is sized to receive the motor 130 and gearbox 135. The motor-gearbox diameter 305 in one variation is at most 40 millimeters (mm). The housing 140 at the handle 105 in one example has a housing length 307 that is at most 160 mm. The housing length 307 and the length of the handle 105 can be longer in other examples to allow digging with the handheld shovel device 100 while the user is standing. The blade 145 at the shovel portion 110 in one form has a blade width 310 that is at most 112 mm, and as measured from the shoulder 210 of the blade 145 to the tip 235 of the auger bit 150, the shovel portion 110 has a shovel portion height 315 of at most 235 mm. In one example, the auger bit 150 has at auger bit height 320 of at most 220 mm, as measured from the shank 230 to the tip 235.

Looking at FIG. 4, an outer radial edge 405 of the web 240 contacts or nearly contacts an inner surface 410 of the body 215 of the blade 145. In one form, the outer radial edge 405 of the web 240 slightly rubs against the inner surface 410 of the blade 145. This close proximity between the web 240 of the auger bit 150 and the blade 145 helps to retain the soil or debris plug within the flute 245 of the auger bit 150 during removal of the handheld shovel device 100 from the dug cavity. In other variations, a clearance gap 415 of at most 1 centimeter (cm) can be formed between the outer radial edge 405 of the web 240 and the inner surface 410 of the body 215 that still allows this retention of the debris plug. The auger bit 150 has an auger bit diameter 420 that is measured to the outer radial edge 405. In one variation, the auger bit diameter 420 is at most 95 mm. As can be seen, the body 215 of the blade 145 stretches to surround about half of the circumference of the auger bit 150 to form the discharge opening 217. Again, the discharge opening 217 allows some of the debris to be ejected from the hole as the auger bit 150 digs the hole, and this shape of the blade 145 helps to retain some of the soil within the flute 245 when the auger bit 150 is stopped and the shovel portion 110 is pulled from the hole.

Figure 5:
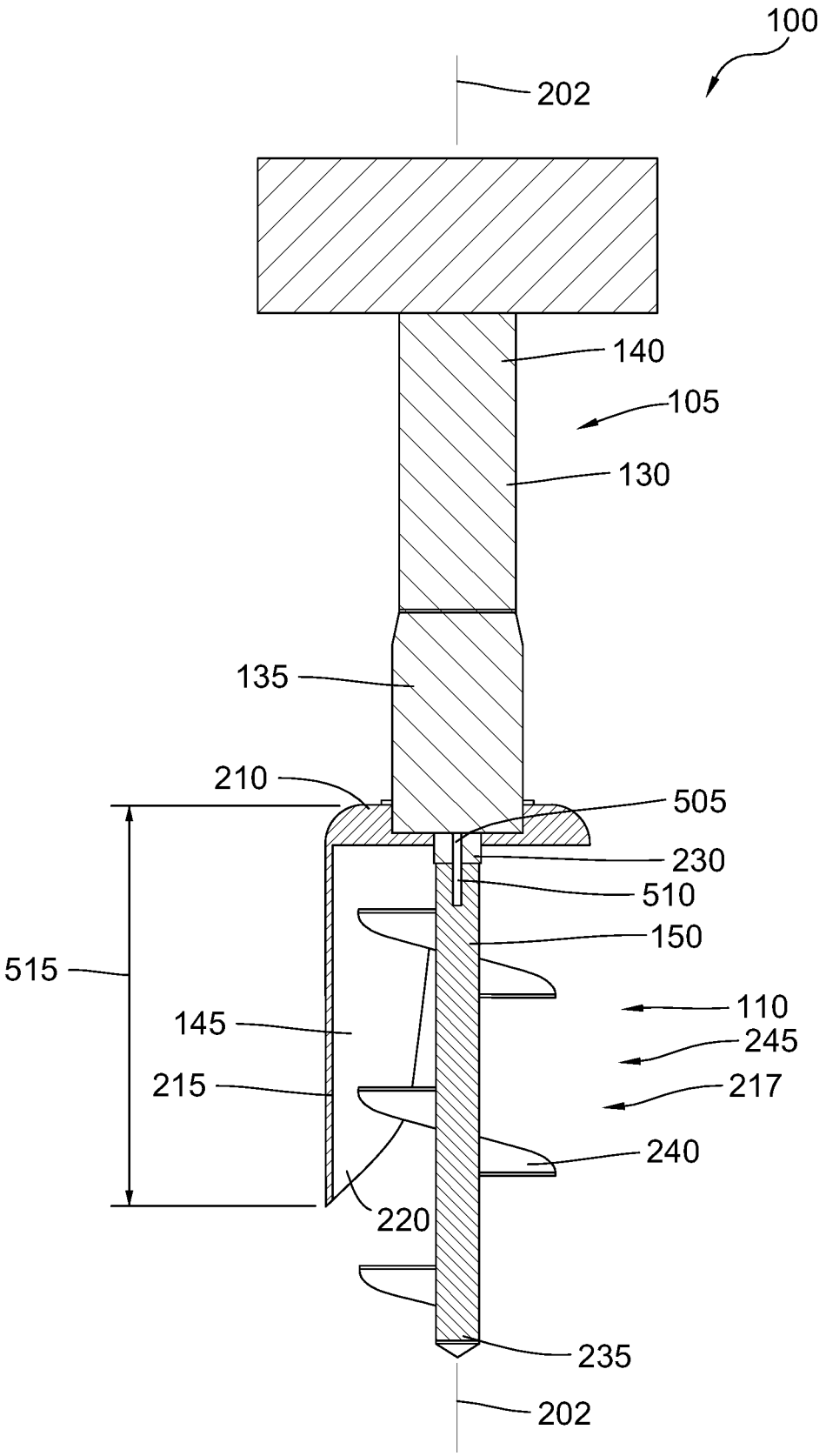
FIG. 5 is a cross-sectional view of the FIG. 2 handheld shovel device as taken along line 5-5 in FIG. 4.

FIG. 5 shows a cross-sectional view of the handheld shovel device 100 as taken along line 5-5 in FIG. 4. As can be seen, the blade 145 is offset or positioned to generally cover one side of the auger bit 150 such that the other side of the auger bit 150 is exposed. In other words, the blade 145 is positioned to one side of the longitudinal axis 202 in FIG. 5. With one side of the auger bit 150 exposed at the discharge opening 217, the handheld shovel device 100 can be drawn in a lateral direction so that the exposed side of the auger bit 150 at the discharge opening 217 is able to cut a furrow or trench in the soil.

As shown, the auger bit 150 is attached to the gearbox 135. In particular, the gearbox 135 has an output shaft 505, and the shank 230 of the auger bit 150 has a shank cavity 510 that receives the output shaft 505 of the gearbox 135. The shoulder 210 of the blade 145 is secured to the housing 140 of the handle 105. In one example, fasteners, such as screws, are used to secure the blade 145 to the housing 140. Alternatively or additionally, the blade 145 can be secured to the handle 105 in other ways, such as via welding, adhesives, etc. In another example, the blade 145 is integrally formed with the housing 140 as a single component, such as through injection molding. As can be seen, the blade 145 has a blade height 515 that is measured from the shoulder 210 to the furthest part of the cutting edge 220. In one form, the blade height 515 is at most 190 mm. Looking at FIG. 5, the auger bit 150 is longer than the blade 145 such that the tip 235 extends past the cutting edge 220 of the blade 145. With the tip 235 of the auger bit 150 extending past the blade 145, the tip 235 of the auger bit 150 is able to first touch and drill into the ground.

Figure 6:
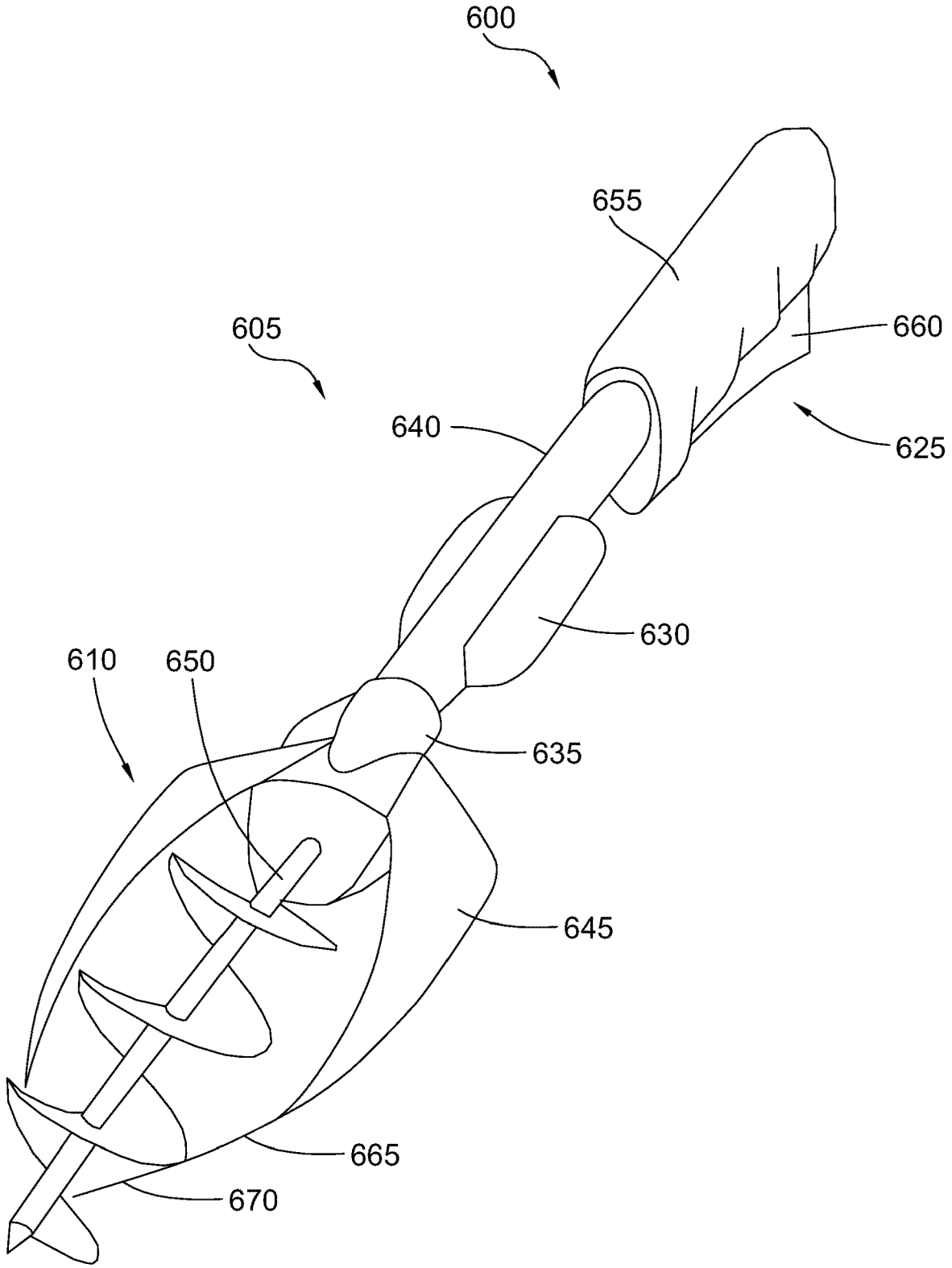
FIG. 6 is a perspective view of a handheld shovel device according to another example.

FIG. 6 shows a handheld shovel device 600 according to another example. As can be seen, the handheld shovel device 600 shares a number of features in common with and operates in a fashion similar to the handheld shovel device 100 described with reference to FIGS. 1, 2, 3, 4, and 5. For the sake of brevity as well as clarity, these common components and functions will not be again described in great detail below, but please reference the previous discussion of these features.

Like before, the handheld shovel device 600 includes a handle 605 and a shovel portion 610. The ESS 115 and controller 120 (FIG. 1) are housed inside the handle 605. The handle 605 further includes an I/O device 625, motor 630, and gearbox 635 configured in a similar fashion as described above. These components are housed inside a housing 640. Similar to before, the shovel portion 610 has a blade 645 and an auger bit 650. The blade 645 is secured to the housing 640 of the handle 605, and the auger bit 650 is mechanically connected to the motor 630 via the gearbox 635.

The handle 605 has a grip 655 where the user grabs the handheld shovel device 600. In one form, the grip 655 includes a foam and/or rubber type grip to ensure a firm and comfortable grip. At the grip 655, the I/O device 625 is in the form of a trigger 660 that controls the operation of the auger bit 650 through the motor 630. In one particular example, the trigger 660 is in the form of a multi-position trigger. In the illustrated example, the blade 645 has a cutting edge 665 with a pointed tip 670.

A technique for digging a hole with the handheld shovel device 100 will now be described with reference to FIGS. 7, 8, and 9. While the technique will be described with reference to the handheld shovel device 100 illustrated in FIG. 2, this technique can also be performed with the handheld shovel device 600 shown in FIG. 6 as well as other similar designs. This technique will be described with reference to digging a hole in the ground or soil, but it should be recognized that this technique can be used to dig other types of cavities in other substrates and/or materials (e.g., sand, peat, mulch, etc.).

Figure 7:
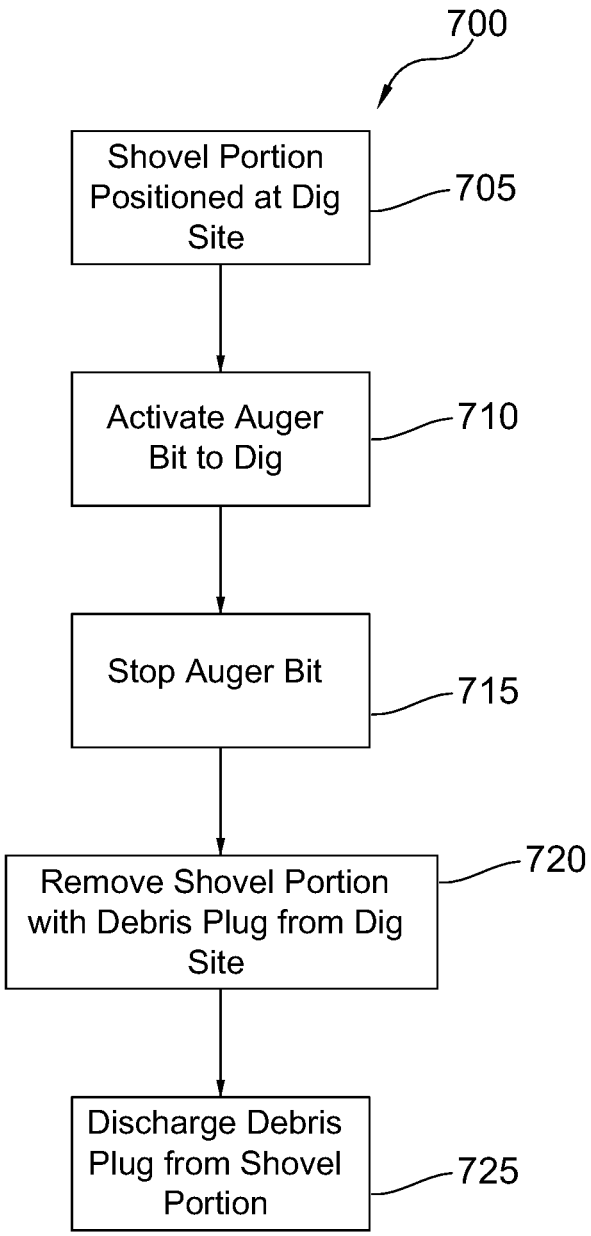
FIG. 7 is a flowchart illustrating a technique for digging a hole with the handheld shovel device.
Figure 8:
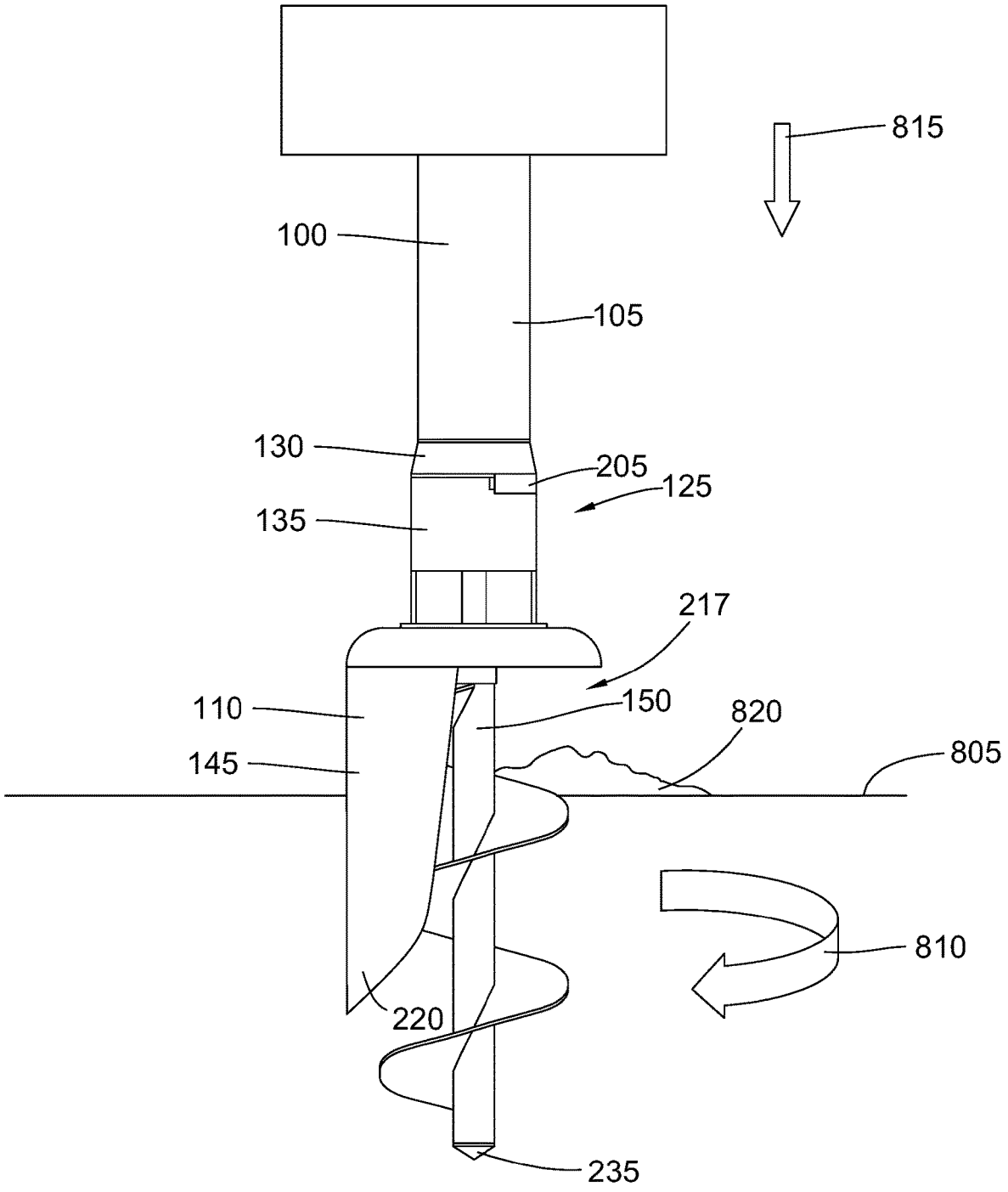
FIG. 8 is a first side view of the handheld shovel device digging into the ground.

FIG. 7 shows a flowchart 700 illustrating this technique. As noted before, the handheld shovel device 100 is sized, shaped, and weighted in such a manner that the handheld shovel device 100 can be easily picked up and handled by the user or operator. The user typically grips or holds the handheld shovel device 100 by the handle 105 in one hand. In stage 705, the shovel portion 110 of the handheld shovel device 100 is positioned at a site for the hole. Looking at FIG. 8, the tip 235 of the auger bit 150 is placed against the surface of the ground 805.

In stage 710, the user via the I/O device 125 activates the motor 130 to cause the auger bit 150 to drill into the ground 805. In one example, when the multiway switch 205 is set to a rightmost position, the motor 130 rotates the auger bit 150 in a counterclockwise direction 810 (i.e., from the bottom view in FIG. 4) to cause the auger bit 150 to dig into the ground 805. It should be recognized that the auger bit 150 can be rotated in the opposite manner when the auger bit 150 has a web 240 with the opposite helical pattern. As the user continues to grip the handle 105, the handheld shovel device 100 moves into the ground 805 in an insertion direction 815 (e.g., a downward direction). As the handheld shovel device 100 burrows into the ground 805, some debris 820, such as cuttings, roots, soil, and/or gravel, is discharged from the auger bit 150 and onto the surface of the ground 805 on a side opposite the blade 145 from the discharge opening 217. During digging, the blade 145 further prevents the soil from back filling into a hole 905 (FIG. 9) being dug.

Figure 9:
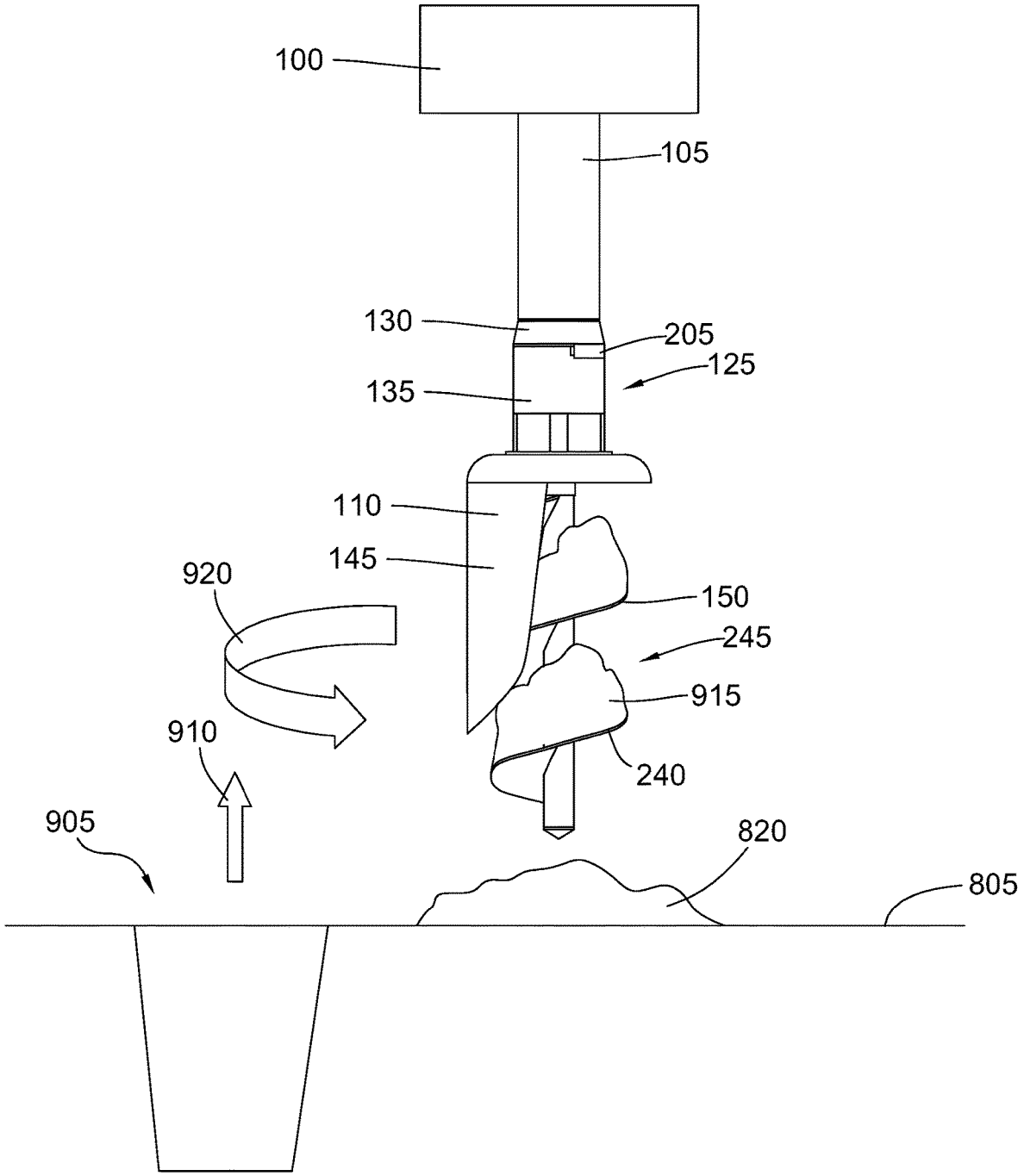
FIG. 9 is a second side view of the handheld shovel device discharging in a clockwise direction from the hole.

Turning to FIG. 9, once the handheld shovel device 100 reaches the desired depth for the hole 905, the user actuates the I/O device 125 in stage 715 to stop the auger bit 150 from turning and digging. In one particular example, when the multiway switch 205 is set to a middle position, the motor 130 is stopped so that the auger bit 150 ceases rotation. In stage 720, the user pulls on the handle 105 in a removal direction 910 (e.g., upward direction) out of the hole 905. In certain cases, such as with moist soil and/or clay soil, the blade 145 helps to retain a debris plug 915 in the flute 245 between the web 240 as the handheld shovel device 100 is pulled in the removal direction 910 from the hole 905. This helps to prevent the debris 820 from falling back into the hole 905.

In stage 725, the debris plug 915 is discharged from the shovel portion 110 of the handheld shovel device 100 onto the pile of the debris 820 on the surface of the ground 805 or elsewhere. Depending on the soil conditions, the debris plug 915 can for example be in the form of a single clump of dirt or multiple clumps of dirt. Under dry conditions, the debris plug 915 can be for instance in the form of loose dirt or gravel. To accomplish this discharge of the debris plug 915, the user actuates the I/O device 125 to cause the motor 130 to rotate the auger bit 150 in a clockwise direction 920 (i.e., from the bottom view in FIG. 4). In one specific example, when the multiway switch 205 is set to a left most position, the motor 130 through the gearbox 135 rotates the auger bit 150 in the clockwise direction 920 to discharge the debris plug 915 that was removed from the hole 905. In the illustrated example, the debris plug 915 from the shovel portion 110 in FIG. 9 is dropped on top of the same pile of debris 820 shown in FIG. 8, but in other examples, the debris plug 915 can be dropped elsewhere. The technique can be repeated to make the hole 905 deeper/larger or to dig another hole 905. For example, the handheld shovel device 100 in stage 710 can be drawn in a lateral direction so that the exposed side of the auger bit 150 at the discharge opening 217 is able to cut a furrow or trench in the ground 805.

Figure 10:
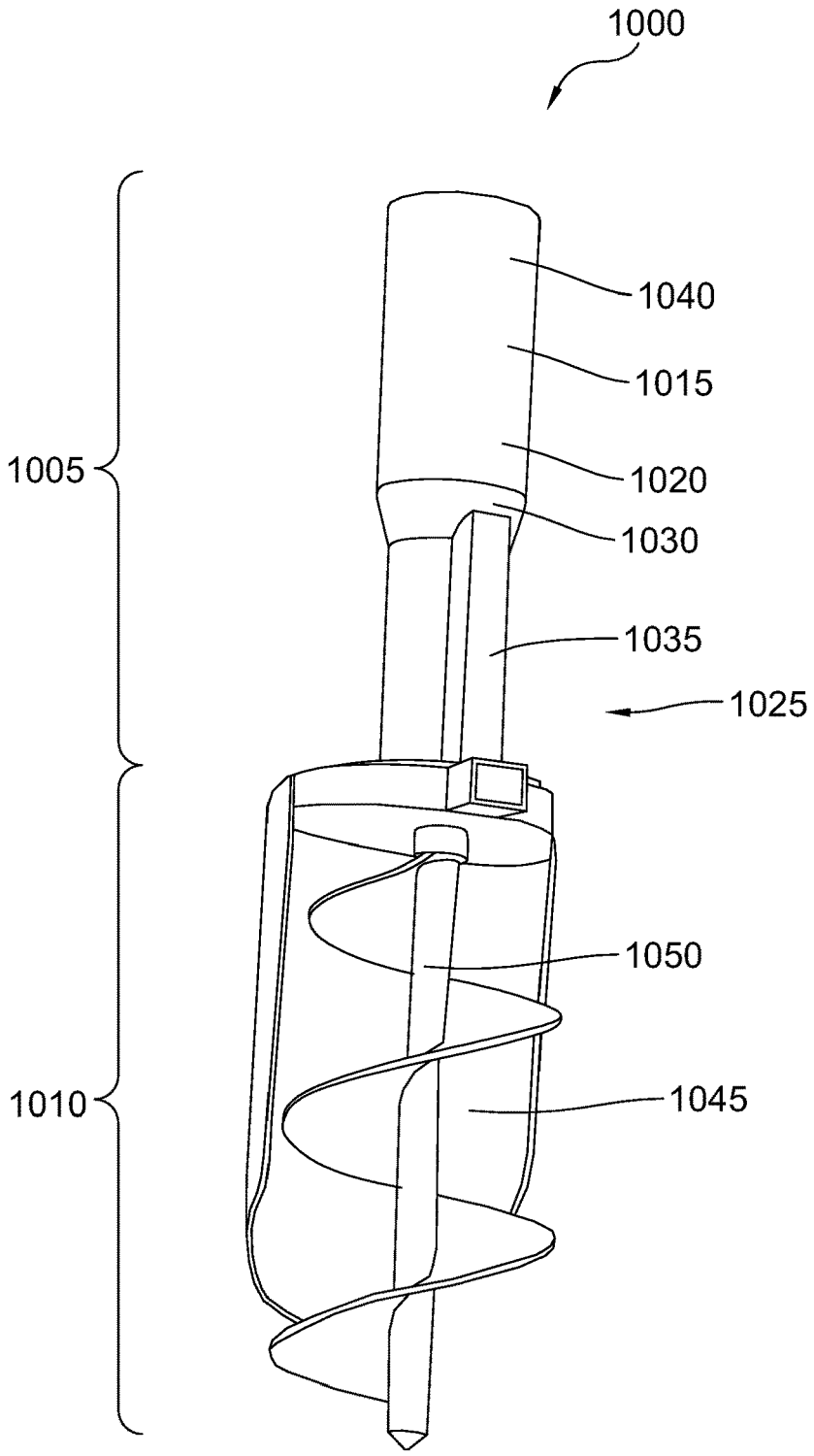
FIG. 10 is a perspective view of a handheld shovel device according to a further example.

FIG. 10 shows a handheld shovel device 1000 according to another example. As can be seen, the handheld shovel device 1000 shares a number of features in common with and operates in a fashion similar to the handheld shovel device 100 described with reference to FIGS. 1, 2, 3, 4, and 5. For the sake of brevity as well as clarity, these common components and functions will not be again described in great detail below, but please reference the previous discussion of these features.

Like before, the handheld shovel device 1000 includes a handle 1005 and a shovel portion 1010. An ESS 1015 and controller 1020 (see e.g., FIG. 1) are housed inside the handle 1005. The handle 1005 further includes an I/O device 1025, a motor 1030, and a gearbox 1035 configured in a similar fashion as described above (see e.g., FIGS. 1 and 2). The handle 1005 has a housing 1040 for housing the components. Similar to before, the shovel portion 1010 has a blade 1045 and an auger bit 1050. The blade 1045 is secured to the housing 1040 of the handle 1005, and the auger bit 1050 is mechanically connected to the motor 1030 via the gearbox 1035.

In the illustrated example, the ESS 1015 and housing 1040 are shaped or configured differently than before. As can be seen, the housing 1040 gives the handle 1005 a smooth appearance that is easily gripped. In this example, the ESS 1015 is housed inside the housing 1040. In one form, the ESS 1015 is in the form of a rechargeable battery that is slid into a cylindrical chamber in the housing 1040. The ESS 1015 can be replaced by being slid out of the chamber in the housing 1040. In another form, the ESS 1015 is permanently installed inside the housing 1040.

Glossary of Terms

The language used in the claims and specification is to only have its plain and ordinary meaning, except as explicitly defined below. The words in these definitions are to only have their plain and ordinary meaning. Such plain and ordinary meaning is inclusive of all consistent dictionary definitions from the most recently published Webster's dictionaries and Random House dictionaries. As used in the specification and claims, the following definitions apply to these terms and common variations thereof identified below.

"Auger Bit" generally refers to a cutting tool used to remove material to create holes, most typically of circular cross-section, when rotated. The auger bit typically, but not always, includes one or more flutes arranged in a spiral or helical pattern to remove chips or other debris. The flute is usually defined between a similarly shaped web that wraps around a shank. There are a number of auger bit styles. For example, a Jennings-pattern bit has a self-feeding screw tip, two spurs, and two radial cutting edges. The Jennings style bit has a double flute starting from the cutting edges, and extending up the shank of the bit, for waste removal. An Irwin or solid-center style auger bit is similar, the only difference being that one of the cutting edges has only a vestigial flute supporting it, which extends only partially up the shank before ending. Typically, but not always, the auger bit is made of a metal, such as steel, for strength purposes.

"Blade" or "Shovel Blade" generally refers to a broad flat or concave part of a tool or machine that comes into contact with material to be moved. Typically, but not always, the blade is made of rigid or semi-rigid material such as metal or plastic. The blade can for example include a square, rounded point, or tapered cutting edge or tip. In some variations, the blade can include a shoulder or step along with a collar for receiving a handle.

"Controller" generally refers to a device, using mechanical, hydraulic, pneumatic electronic techniques, and/or a microprocessor or computer, which monitors and physically alters the operating conditions of a given dynamical system. In one nonlimiting example, the controller can include an Allen Bradley brand Programmable Logic Controller (PLC). A controller may include a processor for performing calculations to process input or output. A controller may include a memory for storing values to be processed by the processor, or for storing the results of previous processing. A controller may also be configured to accept input and output from a wide array of input and output devices for receiving or sending values. Such devices include other computers, keyboards, mice, visual displays, printers, industrial equipment, and systems or machinery of all types and sizes. For example, a controller can control a network or network interface to perform various network communications upon request. The network interface may be part of the controller, or characterized as separate and remote from the controller. A controller may be a single, physical, computing device such as a desktop computer, or a laptop computer, or may be composed of multiple devices of the same type such as a group of servers operating as one device in a networked cluster, or a heterogeneous combination of different computing devices operating as one controller and linked together by a communication network. The communication network connected to the controller may also be connected to a wider network such as the Internet. Thus a controller may include one or more physical processors or other computing devices or circuitry, and may also include any suitable type of memory. A controller may also be a virtual computing platform having an unknown or fluctuating number of physical processors and memories or memory devices. A controller may thus be physically located in one geographical location or physically spread across several widely scattered locations with multiple processors linked together by a communication network to operate as a single controller. Multiple controllers or computing devices may be configured to communicate with one another or with other devices over wired or wireless communication links to form a network. Network communications may pass through various controllers operating as network appliances such as switches, routers, firewalls or other network devices or interfaces before passing over other larger computer networks such as the Internet. Communications can also be passed over the network as wireless data transmissions carried over electromagnetic waves through transmission lines or free space. Such communications include using WiFi or other Wireless Local Area Network (WLAN) or a cellular transmitter/receiver to transfer data.

"Energy Source" generally refers to a device, structure, mechanism, and/or system that provides power for performing work. The energy supplied by the energy source can take many forms including electrical, chemical, electrochemical, nuclear, hydraulic, pneumatic, gravitational, kinetic, and/or potential energy forms. The energy source for instance can include ambient energy sources, such as solar panels, external energy sources, such as from electrical power transmission networks, and/or portable energy sources, such as batteries. The energy source can include an energy carrier containing energy that can be later converted to other forms, such as into mechanical, heat, electrical, and/or chemical forms. Energy carriers can for instance include springs, electrical batteries, capacitors, pressurized air, dammed water, hydrogen, petroleum, coal, wood, and/or natural gas, to name just a few.

"Energy Storage System" (ESS) or "Energy Storage Unit" generally refers to a device that captures energy produced at one time for use at a later time. The energy can be supplied to the ESS in one or more forms for example including radiation, chemical, gravitational potential, electrical potential, electricity, elevated temperature, latent heat, and kinetic types of energy. The ESS converts the energy from forms that are difficult to store to more conveniently and/or economically storable forms. By way of non-limiting examples, techniques for accumulating the energy in the ESS can include: mechanical capturing techniques, such as compressed air storage, flywheels, gravitational potential energy devices, springs, and hydraulic accumulators; electrical and/or electromagnetic capturing techniques, such as using capacitors, super capacitors, and superconducting magnetic energy storage coils; biological techniques, such as using glycogen, biofuel, and starch storage mediums; electrochemical capturing techniques, such as using flow batteries, rechargeable batteries, and ultra batteries; thermal capture techniques, such as using eutectic systems, molten salt storage, phase-change materials, and steam accumulators; and/or chemical capture techniques, such as using hydrated salts, hydrogen, and hydrogen peroxide. Common ESS examples include lithium-ion batteries and super capacitors.

"Fastener" generally refers to a hardware device that mechanically joins or otherwise affixes two or more objects together. By way of nonlimiting examples, the fastener can include bolts, dowels, nails, nuts, pegs, pins, rivets, screws, and snap fasteners, to just name a few.

"Flat" generally refers to an object having a broad level surface but with little height.

"Gearbox" or "Transmission" generally refers to a power system that provides controlled application of mechanical power. The gearbox uses gears and/or gear trains to provide speed and torque conversions from a rotating power source to another device.

"Handheld" generally refers to an object, such as a tool or other device, that has been designed so that object can be easily held, used, and operated with one or two hands of a human being. In other words, a handheld device is designed to be small and light enough to be operated in the hand of a human being for an extended period of time without experiencing significant fatigue.

"Handle" generally refers to a part that is designed especially to be grasped by a human hand. In other words, a handle is a part by which an object, such as a tool or device, is held, carried, and/or controlled by a human hand. A handle typically has sufficient strength to support the object. For tools, the handle typically has sufficient strength to transmit any force from the handle to perform the designed functionality for the tool. The handle usually has a sufficient length to accommodate a single hand or multiple hands to grip and reliably exert force through the handle. Similarly, the handle commonly has a sufficiently small circumference or exterior size to permit single hand or multiple hands to reliably grip the handle. Other ergonomic factors, such as friction, coating, grip, and injury prevention features, can be incorporated into the handle. By way of non-limiting examples, the handles can include broom handles, shovel handles, pull handles, or twist handles, to name just a few.

"Input/Output (I/O) Device" generally refers to any device or collection of devices coupled to a computing device that is configured to receive input and deliver the input to a processor, memory, or other part of the computing device and/or is controlled by the computing device to produce an output. The I/O device can include physically separate input and output devices, or the input and output devices can be combined together to form a single physical unit. Such input devices of the I/O device can include keyboards, mice, trackballs, and touch sensitive pointing devices such as touchpads, or touchscreens. Input devices also include any sensor or sensor array for detecting environmental conditions such as temperature, light, noise, vibration, humidity, and the like. Examples of output devices for the I/O device include, but are not limited to, screens or monitors displaying graphical output, a projecting device projecting a two-dimensional or three-dimensional image, or any kind of printer, plotter, or similar device producing either two-dimensional or three-dimensional representations of the output fixed in any tangible medium (e.g., a laser printer printing on paper, a lathe controlled to machine a piece of metal, or a three-dimensional printer producing an object). An output device may also produce intangible output such as, for example, data stored in a database, or electromagnetic energy transmitted through a medium or through free space such as audio produced by a speaker controlled by the computer, radio signals transmitted through free space, or pulses of light passing through a fiber-optic cable.

"Lateral" generally refers to being situated on, directed toward, or coming from the side.

"Longitudinal" generally relates to the length or lengthwise dimension of an object, rather than across.

"Motor" generally refers to a machine that supplies motive power for a device with moving parts. The motor can include rotor and linear type motors. The motor can be powered in any number of ways, such as via electricity, internal combustion, pneumatics, and/or hydraulic power sources. By way of non-limiting examples, the motor can include a servomotor, a pneumatic motor, a hydraulic motor, a steam engine, a pneumatic piston, a hydraulic piston, and/or an internal combustion engine.

"Power Supply" generally refers to an electrical device that provides electrical power to an electrical load, such as electrical machines and/or electronics.

It should be noted that the singular forms "a," "an," "the," and the like as used in the description and/or the claims include the plural forms unless expressly discussed otherwise. For example, if the specification and/or claims refer to "a device" or "the device", it includes one or more of such devices.

It should be noted that directional terms, such as "up," "down," "top," "bottom," "lateral," "longitudinal," "radial," "circumferential," "horizontal," "vertical," etc., are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by the following claims are desired to be protected. All publications, patents, and patent applications cited in this specification are herein incorporated by reference as if each individual publication, patent, or patent application were specifically and individually indicated to be incorporated by reference and set forth in its entirety herein.

| Reference Numbers | |
|---|---|
| 100 | handheld shovel device |
| 105 | handle |
| 110 | shovel portion |
| 115 | ESS |
| 120 | controller |
| 125 | input/output device |
| 130 | motor |
| 135 | gearbox |
| 140 | housing |
| 145 | blade |
| 150 | auger bit |
| 202 | longitudinal axis |
| 205 | multiway switch |
| 210 | shoulder |
| 215 | body |
| 217 | discharge opening |
| 220 | cutting edge |
| 225 | shaft |
| 230 | shank |
| 235 | tip |
| 240 | web |
| 245 | flute |
| 305 | motor-gearbox diameter |
| 307 | housing length |
| 310 | blade width |
| 315 | shovel portion height |
| 320 | auger bit height |
| 405 | outer radial edge |
| 410 | inner surface |
| 415 | clearance gap |
| 420 | auger bit diameter |
| 505 | output shaft |
| 510 | shank cavity |
| 515 | blade height |
| 600 | handheld shovel device |
| 605 | handle |
| 610 | shovel portion |
| 625 | input/output device |
| 630 | motor |
| 635 | gearbox |
| 640 | housing |
| 645 | blade |
| 650 | auger bit |
| 655 | grip |
| 660 | trigger |

-continued

| Reference Numbers | |
|---|---|
| 665 | cutting edge |
| 670 | pointed tip |
| 700 | flowchart |
| 705 | stage |
| 710 | stage |
| 715 | stage |
| 720 | stage |
| 725 | stage |
| 805 | ground |
| 810 | counterclockwise direction |
| 815 | insertion direction |
| 820 | debris |
| 905 | hole |
| 910 | removal direction |
| 915 | debris plug |
| 920 | clockwise direction |
| 1000 | handheld shovel device |
| 1005 | handle |
| 1010 | shovel portion |
| 1015 | ESS |
| 1020 | controller |
| 1025 | input/output device |
| 1030 | motor |
| 1035 | gearbox |
| 1040 | housing |
| 1045 | blade |
| 1050 | auger bit |

The invention claimed is:

1. A method, comprising:

placing a shovel portion of a handheld shovel in contact with a dig site, wherein the handheld shovel includes a handle and a shovel portion attached to the handle wherein the shovel portion includes a blade and an auger bit, wherein the blade is positioned proximal to the auger bit to retain debris from the auger bit, wherein the auger bit extends along a longitudinal axis, wherein the blade is offset to one side of the longitudinal axis with an opposite side of the auger bit exposed;

digging a hole at the dig site with the auger bit of the handheld shovel, wherein said digging the hole includes rotating the auger bit while the blade remains stationary relative to the handle; and removing the shovel portion of the handheld shovel from the hole with at least some debris retained between the blade and auger bit in the shovel portion.

2. The method of claim 1, further comprising:

discharging the debris from the shovel portion with the auger bit after said removing the shovel portion of the handheld shovel from the hole.

3. The method of claim 1, further comprising:

wherein blade covers a first lateral side of the auger bit;

wherein blade defines a discharge opening that extends along a longitudinal axis to expose a second lateral side of the auger bit;

discharging debris from the hole through the discharge opening while the shovel portion is located in the hole during said digging the hole; and discharging the debris from the shovel portion with the auger bit after said removing the shovel portion of the handheld shovel from the hole.

4. The method of claim 1, further comprising:

wherein the blade defines a discharge opening where the auger bit is exposed; and discharging debris from the hole through the discharge opening while the shovel portion is located in the hole during said digging the hole.

5. The method of claim 1, further comprising:

wherein the handheld shovel includes an input/output (I/O) device and a controller to control rotation of the auger bit; and causing the auger to rotate in a clockwise direction, rotate in a counterclockwise direction, and remain stationary relative to the blade by receiving an input signal from the input/output (I/O) device.

6. The method of claim 5, further comprising:

wherein the I/O device includes a multiway switch mounted to the handle; and causing the auger to rotate in a clockwise direction, rotate in a counterclockwise direction, and remain stationary relative to the blade by actuating the multiway switch.

7. A kit, comprising:

an auger bit;

a handle including a motor, wherein the handle is configured to couple to the auger bit; and a shovel portion with a blade configured to attach to the handle;

wherein the motor is configured to rotate the auger bit while the blade remains stationary relative to the handle; and wherein the blade is positioned proximal to the auger bit to retain debris from the auger bit.

8. The kit of claim 7, wherein the auger bit has a flute that is partially covered by the blade.

9. The kit of claim 8, wherein the blade stretches to surround of the circumference of the auger bit.

10. The kit of claim 7, further comprising:

an Energy Storage System (ESS) configured to power the motor.

11. The kit of claim 10, wherein the ESS includes a rechargeable battery.

12. The kit of claim 7, further comprising:

a recharging station to charge a rechargeable battery.

13. The kit of claim 7, wherein the handle includes a gearbox coupled to the motor configured to supply mechanical power from the motor to the auger bit.

14. The kit of claim 7, wherein the handheld shovel includes an input/output (I/O) device and a controller to control rotation of the auger bit.

15. The kit of claim 14, wherein the I/O device includes a multiway switch mounted to the handle.

16. The kit of claim 15, wherein the multiway switch is configured to cause the auger to rotate in a clockwise direction, rotate in a counterclockwise direction, and remain stationary relative to the blade.

17. A digging device, comprising:

a handheld shovel including a handle and a shovel portion attached to the handle, wherein the shovel portion includes a blade and an auger bit;

wherein the blade is positioned proximal to the auger bit to retain debris from the auger bit;

wherein the blade defines a discharge opening configured to discharge at least some of the debris; and wherein the device is configured to rotate the auger bit while the discharge opening remains stationary relative to the handle.

18. The digging device of claim 17, wherein the handheld shovel includes an input/output (I/O) device and a controller to control rotation of the auger bit.

19. The digging device of claim 18, wherein the I/O device is configured to cause the auger to rotate in a clockwise direction, rotate in a counterclockwise direction, and remain stationary relative to the blade.

20. The digging device of claim 18, wherein the I/O device includes a multiway switch mounted to the handle.

21. The digging device of claim 20, wherein the multiway switch via the controller is configured to cause the auger to rotate in a clockwise direction, rotate in a counterclockwise direction, and remain stationary relative to the blade.

22. The digging device of claim 17, wherein the blade stretches to surround about half of the circumference of the auger bit.

* * * * *